US007232236B2

(12) United States Patent
Vitense et al.

(10) Patent No.: US 7,232,236 B2
(45) Date of Patent: Jun. 19, 2007

(54) FLOOR MARKING APPARATUS AND SYSTEM, AND METHOD OF MARKING A FLOOR

(75) Inventors: Craig T. Vitense, Mazomanie, WI (US); Alexander P. Stoltz, Madison, WI (US)

(73) Assignee: Electronic Theatre Controls, Inc., Middleton, WI (US)

( * ) Notice: Subject to any disclaimer, the term of this patent is extended or adjusted under 35 U.S.C. 154(b) by 190 days.

(21) Appl. No.: 11/031,226

(22) Filed: Jan. 6, 2005

(65) Prior Publication Data

US 2006/0146520 A1 Jul. 6, 2006

(51) Int. Cl.
*F21S 8/00* (2006.01)

(52) U.S. Cl. ..... 362/153; 362/812; 40/560; 116/209; 340/332; 340/691.1

(58) Field of Classification Search ..... 362/153, 362/153.1, 259, 812; 40/550, 560, 565; 116/209; 182/18; 340/332, 691.1, 815.54, 815.55, 340/815.56, 815.57
See application file for complete search history.

(56) References Cited

U.S. PATENT DOCUMENTS 1,065,845 A 6/1913 Sauvage
2,200,959 A 5/1940 Land
2,270,474 A 1/1942 Recher
4,141,056 A 2/1979 Neely
4,160,285 A 7/1979 Shibla
4,347,499 A 8/1982 Burkman, Sr. et al.
4,631,675 A 12/1986 Jacobsen et al.
5,343,374 A 8/1994 Gordin et al.
5,572,183 A 11/1996 Sweeney
6,000,810 A 12/1999 Nolan et al.
6,150,943 A * 11/2000 Lehman et al. ..... 362/259
6,731,079 B2 5/2004 Andersen

* cited by examiner

*Primary Examiner*—Stephen F. Husar
(74) *Attorney, Agent, or Firm*—Greer, Burns & Crain, Ltd.; Philip M. Kolehmainen

(57) ABSTRACT

A floor marking system includes a floor having a predetermined location intended for use of a predetermined character, the predetermined location being marked with impinging light. The floor marking system also includes a lighting unit having a light source for marking light onto the floor at a predetermined location. A patterning device is disposed between the light source and the floor, and is configured and arranged to mark at least one of a graphic pattern and a color onto the floor at the predetermined location with the impinging light. The at least one of the graphic pattern and the color marked on the floor by the lighting unit and the patterning device forms an indicator, and the indicator corresponds to the character of use of the floor at the predetermined location.

21 Claims, 3 Drawing Sheets

FLOOR MARKING APPARATUS AND SYSTEM, AND METHOD OF MARKING A FLOOR

FIELD OF THE INVENTION

The present invention relates to floor marking systems in general, and more specifically to an improved floor marking system for a factory and to a method of marking a floor.

DESCRIPTION OF THE PRIOR ART

Under the Occupational Safety and Health Standards Act (OHSA), Federal law dictates that workplaces be marked with certain safety information. Particularly in industrial workplaces, current laws require the marking of permanent aisles and passageways. Further, it is advantageous to mark the floors with information regarding hazards and safety in the workplace, such as low clearances and the location of emergency exits. Floor markings can also increase efficiency in the workplace by designating locations for a specific character of use, and by generally adding to the organization of the workplace.

Floor marking systems are known in the art. It is conventional in factories and warehouses to mark the floor to show areas such as pedestrian walkways, fork lift lanes, and so forth. Usually this is done by attaching a colored marking material to the floor, such as adhesive-backed tape, or by painting on the floor. Such conventional floor marking systems experience several disadvantages in operation.

One disadvantage experienced by the conventional floor markings is that the markings wear out or fade. In the case of floor paint, the paint must be renewed periodically when fading occurs. Further, when adhesive-backed tape fails, such as by the adhesive failing to adhere to the floor or when the tape tears, new tape must be reapplied. The maintenance of paint and tape is both time consuming and labor intensive.

Another disadvantage experienced by the conventional floor markings is that when the factory or warehouse layout changes, the markings must be removed, such as by scraping off or lifting off the old markings, and new markings must be applied for the new layout. This process of removing and reapplying conventional floor markings is time consuming and labor intensive.

SUMMARY OF THE INVENTION

A floor marking system in accordance with the present invention includes a floor having a predetermined location intended for use of a predetermined character, the predetermined location being marked with impinging light. The floor marking system also includes a lighting unit having a light source for marking light onto the floor at a predetermined location. A patterning device is disposed between the light source and the floor, and is configured and arranged to mark at least one of a graphic pattern and a color onto the floor at the predetermined location with the impinging light. The at least one of the graphic pattern and the color marked on the floor by the lighting unit and the patterning device forms an indicator, and the indicator corresponds to the character of use of the floor at the predetermined location.

Further in accordance with the invention, a floor includes a floor surface having a predetermined location intended for floor traffic of a predetermined character. The predetermined location is marked by impinging light containing a color and a graphic pattern corresponding to the character of the floor traffic.

Further in accordance with the invention, a floor includes a floor surface having a predetermined location intended for receiving and storing objects of a predetermined character. The predetermined location is marked by impinging light containing a color and a graphic pattern corresponding to the character of the objects to be received and stored.

A patterning device is provided for projecting an indicator onto a predetermined location on a floor using a light source, the predetermined location intended for use of a predetermined character, and includes a transparent, colored member configured for placement between the light source and the floor for marking the predetermined location with impinging, colored light. A pattern on the transparent member is used for marking the predetermined location with impinging light defining a graphic pattern. Further, the color and the graphic pattern correspond to the character of use of the floor at the predetermined location.

In accordance with another aspect of the invention, a method for marking a floor to indicate the designated use of the floor includes the steps of positioning a lighting unit having a light source for projecting a beam of light onto the floor at a predetermined location having a predetermined character of use, and placing an optical device between the light source and the floor. The optical device is configured and arranged to modify the beam of light to mark information onto the floor at the predetermined location with impinging light. A further step includes illuminating the floor with the information forming an indicator with the impinging light, where the information corresponds to the character of use of the floor at the predetermined location.

BRIEF DESCRIPTION OF THE DRAWING

The present invention together with the above and other objects and advantages may best be understood from the following detailed description of the preferred embodiment of the invention illustrated in the drawings, wherein.

DETAILED DESCRIPTION OF THE PREFERRED EMBODIMENT

Figure 1:
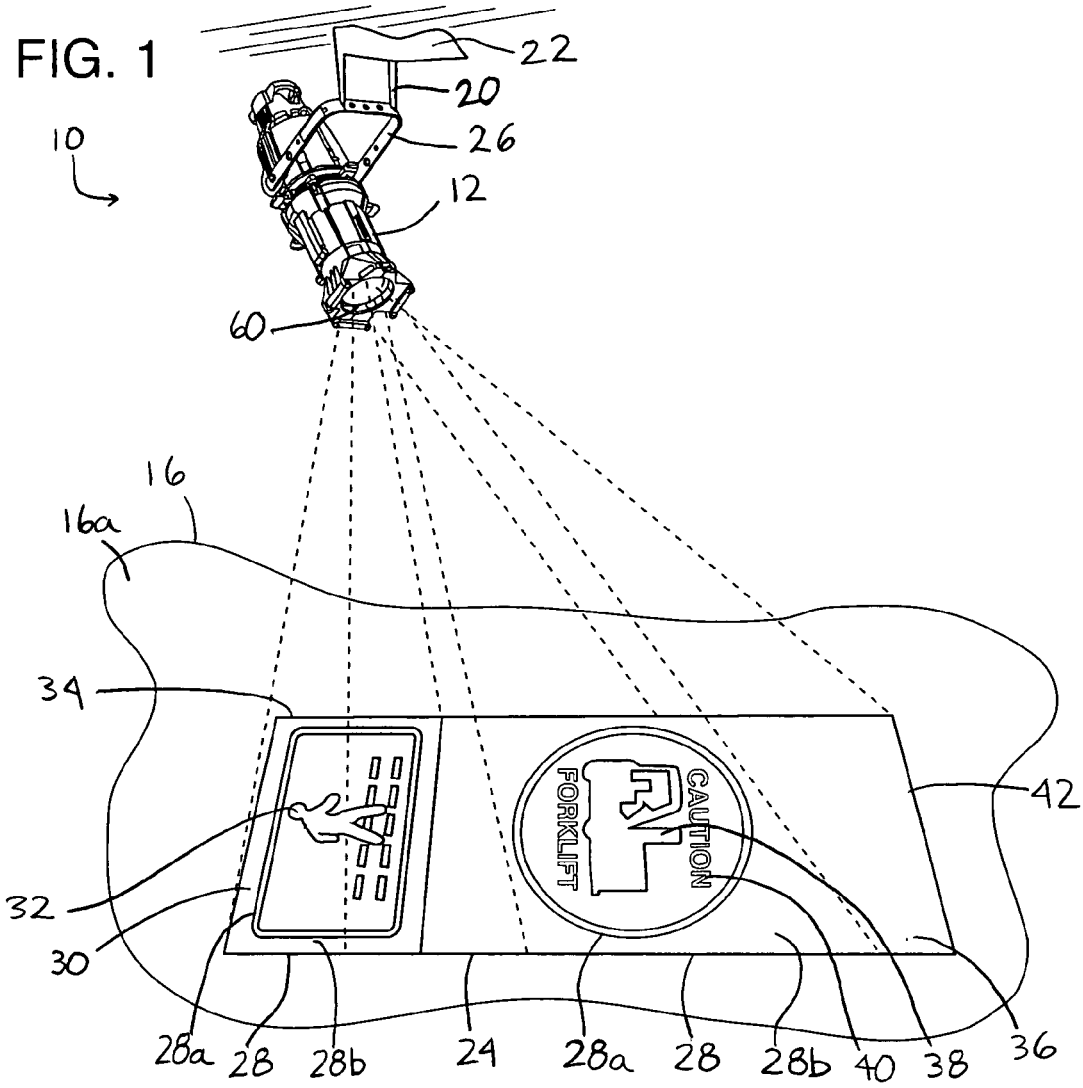
FIG. 1 is a; perspective view of the floor marking apparatus of the present invention.
Figure 2:
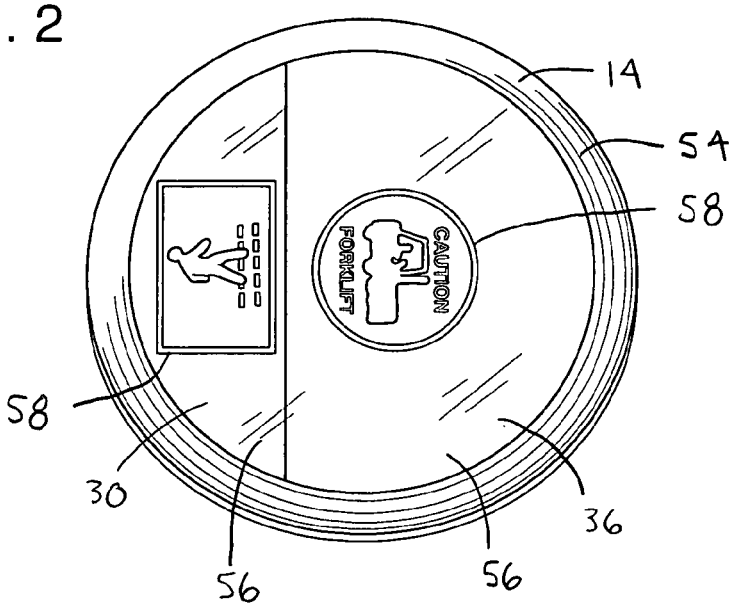
FIG. 2 is a front view of a patterning device for use in the floor marking apparatus of FIG. 1.

Referring now to FIGS. 1 and 2, there is illustrated a floor marking apparatus in accordance with the present invention generally designated 10, including a lighting unit 12, a patterning device 14 and a floor 16. The floor marking apparatus 10, as shown and described, is constructed and arranged to project light onto the floor 16 of a industrial building, such as a factory or a warehouse, to indicate fork lift lanes, pedestrian lanes, and the like. It is contemplated that the floor marking apparatus 10 can be used in commercial or private settings, as well as outside of buildings.

The lighting unit 12 of the preferred embodiment is an ellipsoidal reflector spotlight having a light source (not shown) for projecting light. The light source in the lighting unit 12 is preferably An arc source, however it is contemplated that other lighting units using other light sources such as a tungsten filament lamp can be used. In the preferred embodiment, the lighting unit 12 is preferably removably attached to a positioning point 20, preferably on a ceiling 22 or other surface, such that the light emitted from the lighting unit 12 is projected to a predetermined location 24 on the floor 16.

The predetermined location 24 is intended for use of a predetermined character. For example, the floor 16 has a floor surface 16*a* that may be intended for floor traffic of a predetermined character, such as forklift traffic or pedestrian traffic. Further, the floor surface 16*a* may be intended for receiving and storing objects, such as objects to be transported from one area of the factory to another location. Further, it is contemplated that the predetermined location 24 may be used for other uses, such as to keep clear of objects, for example near an emergency exit.

The floor surface 16*a* receives impinging light emitted from the lighting unit 12 at the predetermined location. Depending on the lighting unit 12, photometric data associated with the unit can be used to position the lighting unit on the positioning point 20 to project the beam of light at the predetermined location 24. For example, using a particular lighting unit 12, the distance from the lighting unit to the predetermined location 24, the field diameter of the light projected, and the illumination at the predetermined location can be determined. In the preferred embodiment, a 36-degree lighting unit 12 is positioned about 27-feet from the predetermined location 24 on the floor 16.

Further, the lighting unit 12 can simply be placed on the positioning point 20, and if the light projected is not desirable, the characteristics of the lighting unit can be changed such as by interchanging lenses and lamps. Further still, the direction of the light beam is preferably adjustable by moving the lighting unit 12 relative to the positioning point 20. Preferably, a mounting member or yoke 26 is disposed on the lighting unit 12 to attach the lighting unit to the positioning point 20, and further, enables adjustment of the direction of projection of the lighting unit.

At the floor 16, an indicator 28 is projected from the lighting unit 12. The indicator 28 conveys information related to the character of use of the floor 16 at the predetermined location 24, such as safety or utility information. Preferably, the indicator 28 conveys safety or utility information relevant to an industrial building, such as a factory or warehouse, at that predetermined location 24. The indicator 28 is formed of at least a graphic pattern 28*a* or a color 28*b* which appears at the floor surface 16*a*, and which corresponds to the character of use of the floor 16 at the predetermined location 24. The indicator 28 being marked by impinging light onto the floor 16 preferably corresponds to the character of floor traffic, or the character of objects to be received and stored at the predetermined location 24.

Examples of indicators 28 are shown in FIG. 1. In a first example, the indicator 28 may be a region 30 of the floor 16 colored green and a pattern 32 of a person walking. This indicates that the predetermined location 24 on which the indicator 28 is projected is a pedestrian walkway 34 and that it is safe to walk there.

In another example, the indicator 28 may be a region 36 colored orange, a symbol 38 of a fork lift, and a legend 40 stating "CAUTION FORKLIFT", to indicate that the predetermined location 24 on which the indicator is projected is a fork lift lane 42, and that a person should proceed with caution.

Figure 3A:
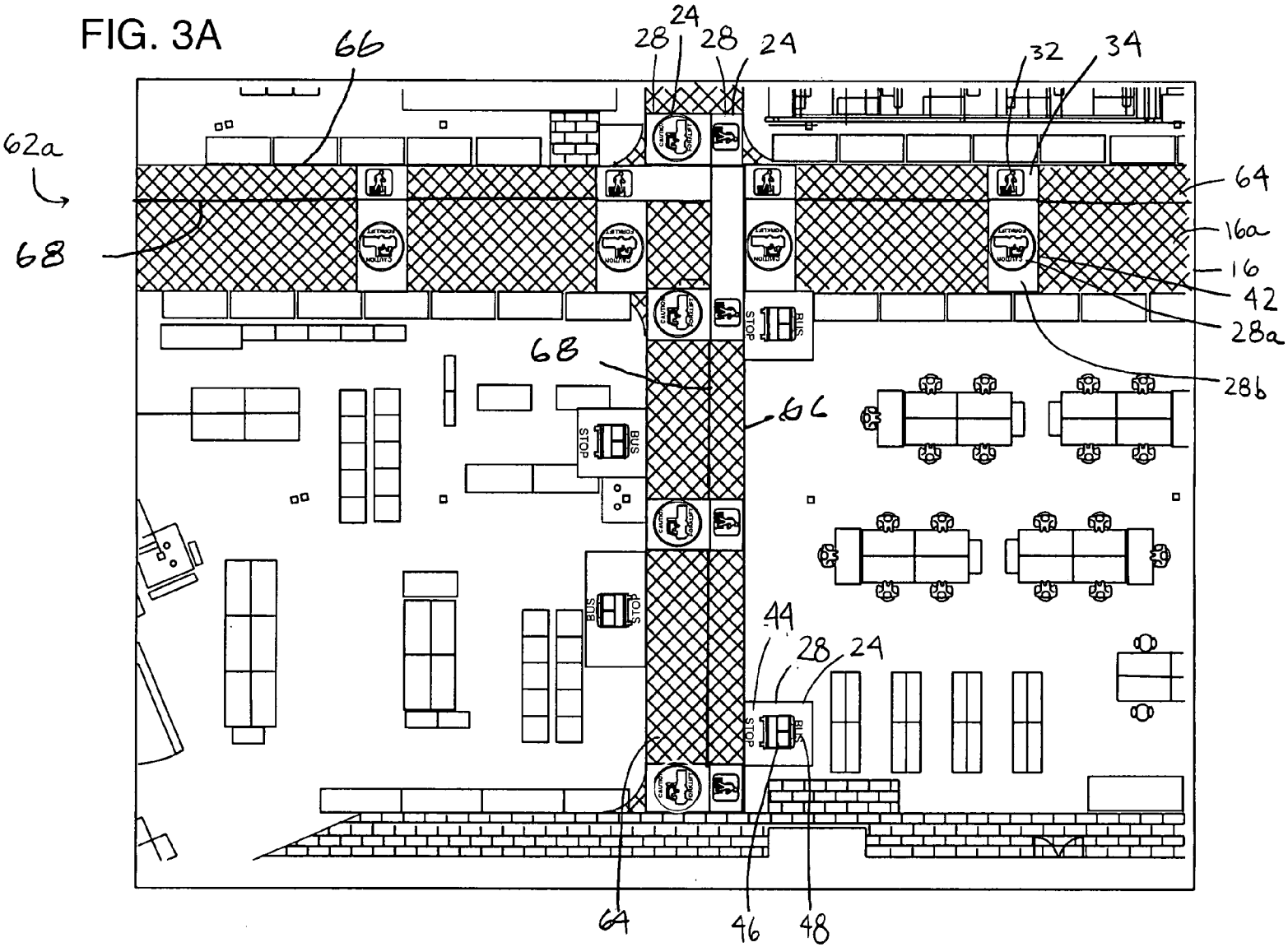
FIG. 3A is a schematic plan view of a factory floor using the floor marking system of the present invention and having a first layout.
Figure 3B:
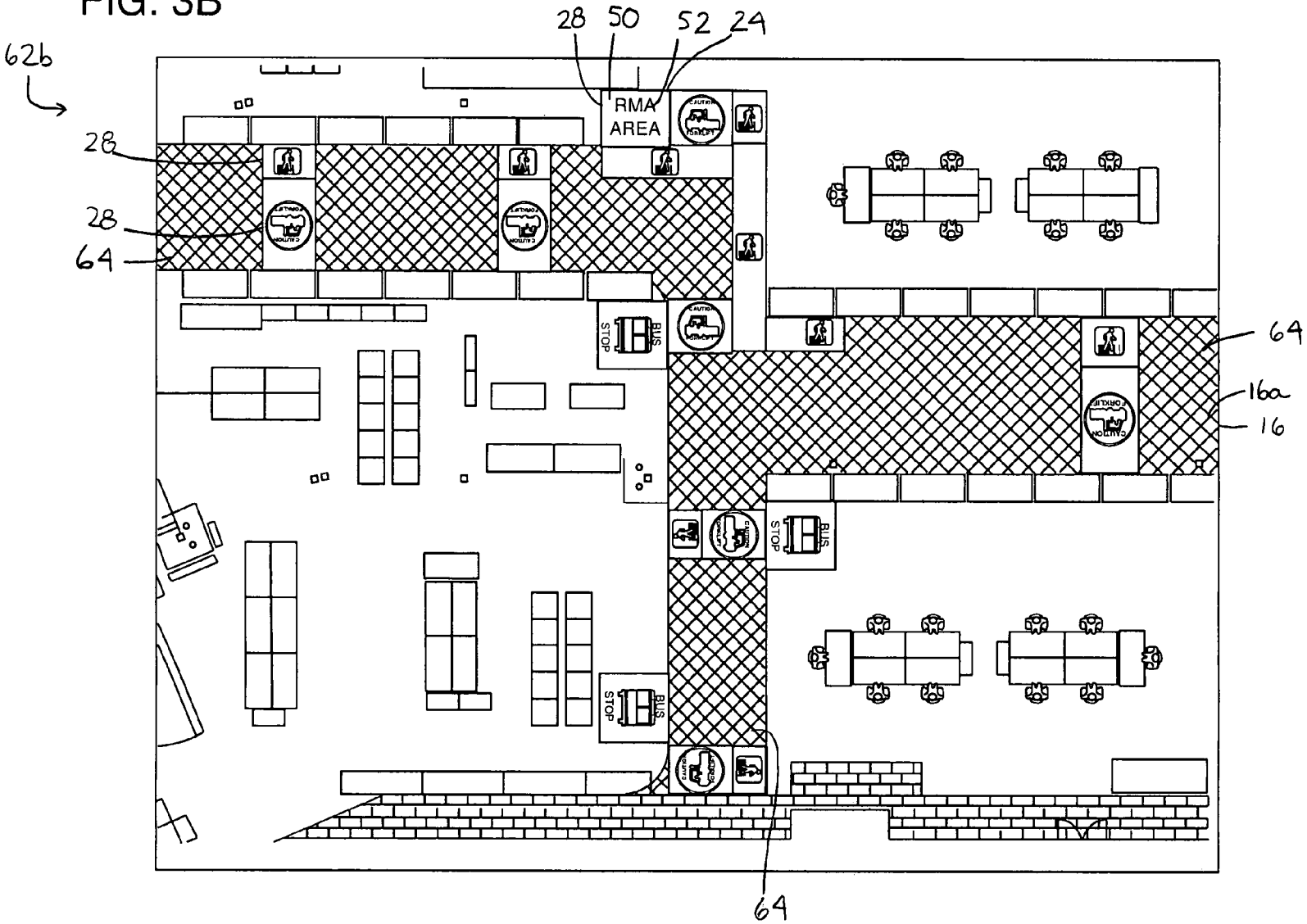
FIG. 3B is a schematic plan view of the factory floor of FIG. 3A rearranged to a different, second layout.

Examples of other indicators are shown in FIGS. 3A and 3B. For example, the indicator 28 may be a region 44 colored blue, a symbol 46 of a bus, and a legend 48 stating "BUS STOP", to indicate that a fork lift or vehicle stops at the predetermined location to load or unload goods.

In still a further example, the indicator 28 may be a region 50 colored red 50 and a legend 52 stating "RMA AREA". In this particular example, the indicator 28 may indicate that goods not passing quality control standards should be placed there.

It should be understood that the invention is not limited to these examples, but that the indicator 28 can be used to convey any sort of information that is relevant to the predetermined location 24. For example, in a retail space, the indicator may be a legend stating "LINE FORMS HERE", indicating that the predetermined location is where people should line up to make their purchases.

Referring again to FIGS. 1 and 2, to project an indicator 28 on to the predetermined location 24, an optical device, preferably a patterning device 14, is disposed between the light source (not shown) and the floor. The patterning device 14 is preferably a gobo 54. A gobo 54 has a transparent body 56, preferably a dichroic glass filter, having a pattern 58 etched, removed, blocked or otherwise defined, which is placed into the lighting unit 12. Other materials such as metal or colored glass may be used. Alternatively, the patterning device 14 can be positioned adjacent the exterior of the light source. A plastic material may be used if the patterning device is external. The patterning device 14 is configured and arranged to modify the beam of light from the lighting unit 12 to mark information onto the floor 16 at the predetermined location 24 with the impinging light.

In the preferred embodiment, the gobo 54 is a sheet 56 of glass, preferably a dichroic glass filter, having a color or capable of transmitting a color corresponding to the projected color 28*b*. The member 56 is preferably etched to define the pattern 58 corresponding to the projected graphic pattern 28*a*. At the point of etching, the otherwise colored, transparent member 56 is preferably colorless. Thus, in the gobo 54 of FIG. 2, the member 56 has, or transmits, the colors green 30 and orange 36 and has two etched patterns. This configuration results in the projected indicators 28 including green 30 and orange 36 regions with "white" or non colored graphic portions 28*a* corresponding to the patterns 58 etched, as is known in the art.

In a similar configuration, the pattern 58 on the gobo 54 may be blocked or otherwise made opaque, resulting in the indicator 28 appearing as projected light in some portions, and appearing as a graphic 28*a* of "blocked" light in other portions. Further, the indicator 28 projected by the patterning device 14 may be a color 28*b* without a graphic pattern 28*a*, or may be a pattern without a color. Additionally, other types of patterning devices 14 may be used, such as a sheet of metal with portions removed, as is known in the art.

Preferably, the patterning device 14 is placed inside the lighting unit 12, and with the appropriate focusing, the indicator 28 is projected onto the floor 16 at the predetermined location 24. Depending on the type of lighting unit 12, a receiving slot 60 may be disposed on the lighting unit 12 to receive the patterning device 14.

The direction of light projection of the lighting unit 12 is preferably adjustable at the positioning point 20. In the event that the layout of the factory or the warehouse changes, the lighting unit 12 can be rotated, moved, or otherwise adjusted at the positioning point 20. However, if the layout of the factory or the warehouse changes to the extent that the location of the positioning point 20 does not enable the lighting unit 12 to project light on the new predetermined location 24, the lighting unit can be attached to a new positioning point 20.

In typical installation, a plurality of lighting units 12 and patterning devices 14 are used to project indicators 28 onto a number of portions of a floor. Referring now to FIG. 3A, a first exemplary factory layout 62*a* has two aisles 64, which intersect generally centrally on one side of the layout. Projected onto the aisles 64 and the factory floor 16 at predetermined locations 24 are indicators 28 preferably having colors 28*b* and/or graphic patterns 28*a*. The indicators 28 having the symbol of a fork lift 38 indicate fork lift lanes 42, the indicators having the symbol of a person walking 32 indicate pedestrian corridors, and the indicators having the symbol of a bus 46 indicate where goods should be placed for pickup. Each indicator 28 has an associated lighting unit 12 that is projecting the indicator onto the floor 16.

The indicators 28 having the symbol 32 of a person walking are located at spaced apart regions along pedestrian aisles defined between reference lines 66 and 68. In accordance with the invention, lighting units 12 may be used to light these aisles along their full lengths, thus providing a visual guide along the entire pathway. In the aisle regions between the symbols 32, the lighting units may have patterning devices with colors 28*b* without patterns 28*a*. In this exemplary case, the pedestrian aisles are colored green throughout, with spaced apart regions having the symbols 28*a*.

The present invention makes it easy to alter the floor marking arrangement to accommodate changes in the factory floor layout. Referring now to FIG. 3B, the layout of the factory 62*b* has been changed with respect to FIG. 3A. In FIG. 3B, there are three aisles 64 which intersect at different points, and the "RMA AREA" indicator 52 is marked on the floor 16. The location of the indicators 28 is changed to suit the new layout 62*b*, and the associated lighting units 12 have been either reaimed or moved. This is much faster and easier than removing and reapplying conventional floor marking tapes or paints.

The present invention can be embodied in the form of a kit that includes one or a number of lighting units 12 together with a selection of a plurality of different patterning devices 14. The patterning devices 14 in the kit can contain information in the form or color and/or graphics corresponding to different uses to which portions of a floor may be put. The user of the kit mounts the lighting unit or units 12 in desired locations and selects the appropriate patterning device or devices to mark a floor to suit a desired layout.

While the present invention has been described with reference to the details of the embodiment of the invention shown in the drawing, these details are not intended to limit the scope of the invention as claimed in the appended claims.

What is claimed is:

1. A floor marking system for a factory or warehouse, comprising:

a floor having a predetermined location intended for use of a predetermined character, said predetermined location being marked with impinging light;

a lighting unit having a light source for marking light onto said floor at said predetermined location; and a patterning device disposed between said light source and said floor, wherein said patterning device is configured and arranged to mark at least one of a graphic pattern and a color onto said floor at said predetermined location with said impinging light;

wherein said at least one of a graphic pattern and a color marked on said floor by said lighting unit and said patterning device forms an indicator; and wherein said indicator corresponds to the normal, non-emergency character of use of said floor at said predetermined location;

wherein the floor marking system is selectively activated by a user to indicate the normal, non-emergency use of the floor.

2. The floor marking system as defined in claim 1, wherein said lighting unit comprises multiple lighting units and said patterning device comprises multiple interchangeable patterning devices for marking multiple indicators on said floor.

3. The floor marking system as defined in claim 2, wherein said predetermined location comprises multiple predetermined locations, wherein said multiple indicators are marked at said multiple predetermined locations.

4. The floor marking system as defined in claim 1, wherein said indicator conveys information relevant to safety or utility in the factory or warehouse at said predetermined location.

5. The floor marking system as defined in claim 1, wherein said lighting unit is removably attached to a positioning point, and the direction of light projection of said lighting unit is adjustable at said positioning point.

6. A floor marking kit for marking a floor having a predetermined location intended for use of a predetermined character, comprising:

a lighting unit having a light source for marking light onto the floor at the predetermined location; and a plurality of interchangeable patterning devices configured to be disposed adjacent said light source, wherein said patterning devices are configured and arranged to mark at least one of a graphic pattern and a color onto the floor at the predetermined location with impinging light;

wherein said at least one of a graphic pattern and a color marked on the floor by said lighting unit and said patterning device forms an indicator; and wherein said indicator corresponds to the character of use of the floor at the predetermined location;

wherein said plurality of patterning devices are interchangeable in response to a change in the character of use of the floor at the predetermined location.

7. The floor marking kit as defined in claim 6, wherein said indicator conveys information relevant to safety or utility in a factory or warehouse at said predetermined location.

8. The floor marking kit as defined in claim 7, wherein said indicator comprises one of "CAUTION FORKLIFT", "BUS STOP", "RMA AREA", and a symbol of a pedestrian.

9. The floor marking kit as defined in claim 6, wherein said lighting unit is configured to removably attach to a positioning point, and is configured to adjust the direction of light projection at said positioning point.

10. The floor marking kit as defined in claim 6, wherein said patterning device comprises a gobo for attachment to said lighting unit.

11. A floor comprising:

a floor surface;

said floor surface having a first predetermined location intended for floor traffic of a first predetermined character;

said first predetermined location being marked by impinging light forming a first indicator containing at least one of a first color and a first graphic pattern corresponding to said character of said first floor traffic;

said floor surface having a second predetermined location intended for floor traffic of a second predetermined character different from said first predetermined character;

said second predetermined location being marked by impinging light forming a second indicator containing at least one of a second color and a second graphic pattern corresponding to said character of said second floor traffic, wherein said second indicator is different from said first indicator;

wherein said first and second indicators indicate normal, non-emergency character of use of the floor.

12. The floor of claim 11 wherein said first predetermined location is intended for one of forklift traffic and pedestrian traffic.

13. A floor comprising:

a floor surface;

said floor surface having a predetermined location intended for receiving and storing objects of a predetermined character;

said predetermined location being marked by impinging light containing a color and a graphic pattern corresponding to said character of said objects to be received and stored;

wherein said predetermined location is intended for objects to be temporarily stored before being transported elsewhere.

14. A patterning device for projecting an indicator onto a predetermined location on a factory or warehouse floor using a light source, the predetermined location intended for use of a predetermined character, said patterning device comprising:

a transparent, colored member configured for placement between the light source and the floor for marking the predetermined location with impinging, colored light;

a pattern on said transparent member for marking the predetermined location with impinging light defining a graphic pattern forming the indicator;

wherein said color and said graphic pattern corresponds to the normal, non-emergency character of use of the factory or warehouse floor at the predetermined location.

15. The patterning device of claim 14 wherein said graphic pattern comprises one of "CAUTION FORKLIFT", "BUS STOP", "RMA AREA", and a symbol of a pedestrian.

16. The patterning device of claim 14 wherein said transparent, colored member is constructed of one of glass and plastic.

17. A method for marking a floor to indicate designated use of the floor, comprising the steps of:

positioning a lighting unit having a light source for projecting a beam of light onto the floor at a predetermined location having a predetermined character of use;

placing an optical device between said light source and said floor, wherein said optical device is configured and arranged to modify said beam of light to mark information onto the floor at said predetermined location with impinging light; and selectively illuminating said floor with said information forming an indicator with said impinging light;

wherein said information corresponds to the normal, non-emergency character of use of the floor at said predetermined location.

18. The method as defined claim 17, further comprising the step of arranging the patterning device on said lighting unit.

19. The method as defined in claim 17, further comprising the step of changing the location of the lighting unit when said predetermined location changes.

20. The method as defined in claim 17 wherein said optical device comprises a patterning device.

21. The method as defined in claim 17 wherein said indicator comprises at least one of a graphic pattern and a color.

* * * * *